US011045831B2

(12) United States Patent
Mathon et al.

(10) Patent No.: US 11,045,831 B2
(45) Date of Patent: Jun. 29, 2021

(54) DEVICE FOR APPLYING ABRADABLE MATERIAL TO A SURFACE OF A TURBINE ENGINE CASING

(71) Applicant: Safran Aicraft Engines, Paris (FR)

(72) Inventors: Richard Mathon, Moissy-Cramayel (FR); Raoul Jaussaud, Moissy-Cramayel (FR); Dominique Michel Serge Magnaudeix, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 180 days.

(21) Appl. No.: 16/078,451

(22) PCT Filed: Feb. 17, 2017

(86) PCT No.: PCT/FR2017/050353
§ 371 (c)(1),
(2) Date: Aug. 21, 2018

(87) PCT Pub. No.: WO2017/144801
PCT Pub. Date: Aug. 31, 2017

(65) Prior Publication Data

US 2019/0047016 A1 Feb. 14, 2019

(30) Foreign Application Priority Data

Feb. 22, 2016 (FR) ..... 1651430

(51) Int. Cl.
*B05C 7/06* (2006.01)
*B05C 11/02* (2006.01)
(Continued)

(52) U.S. Cl.
CPC ..... *B05C 7/06* (2013.01); *B05C 11/02* (2013.01); *B05C 11/025* (2013.01); *B05C 17/02* (2013.01);
(Continued)

(58) Field of Classification Search
None
See application file for complete search history.

(56) References Cited

U.S. PATENT DOCUMENTS 3,487,519 A 1/1970 Davidson
4,329,308 A 5/1982 Langer et al.
(Continued)

FOREIGN PATENT DOCUMENTS

CN 107708874 A 2/2018
WO WO 2016/203141 A1 12/2016

*Primary Examiner* — Jethro M. Pence
(74) *Attorney, Agent, or Firm* — Blank Rome LLP

(57) ABSTRACT

A device for applying abradable material to a surface of an annular casing of a turbine engine, wherein the casing extends along a longitudinal axis, comprises a support equipped with first guiding means capable of guiding the support in relation to the casing in a radial direction in relation to the axis of the casing. The support is equipped with second guiding means capable of guiding the support in relation to the casing in an axial direction. The device further includes an application roller pivotally mounted in relation to the support in the axial direction and adjustment means allowing adjustment of the position of the roller in relation to the first guiding means, in the radial direction.

11 Claims, 4 Drawing Sheets

(51) Int. Cl.

| | |
|---|---|
| ***B05C 17/02*** | (2006.01) |
| ***F04D 29/52*** | (2006.01) |
| ***F04D 29/02*** | (2006.01) |
| *F01D 11/12* | (2006.01) |
| *B05C 7/00* | (2006.01) |

(52) U.S. Cl.
CPC ..... *F04D 29/023* (2013.01); *F04D 29/526* (2013.01); *B05C 7/00* (2013.01); *F01D 11/122* (2013.01); *F05D 2230/31* (2013.01)

(56) References Cited

U.S. PATENT DOCUMENTS

| | | | | |
|---|---|---|---|---|
| 2004/0146393 | A1 | 7/2004 | Evans et al. | |
| 2014/0367921 | A1 | 12/2014 | Konigs et al. | |
| 2018/0178243 | A1 | 6/2018 | Sacy et al. | |
| 2018/0216478 | A1* | 8/2018 | Martel ..... | C25D 3/12 |

* cited by examiner

DEVICE FOR APPLYING ABRADABLE MATERIAL TO A SURFACE OF A TURBINE ENGINE CASING

CROSS-REFERENCE TO RELATED APPLICATIONS

This application is a national stage of International Application No. PCT/FR2017/050353, filed on Feb. 17, 2017, which claims the benefit of French Patent Application No. 1651430, filed on Feb. 22, 2016, the contents of which are incorporated herein by reference.

TECHNICAL FIELD

The present invention relates to a device for applying abradable material, designed to apply abradable material to a surface of a turbine engine casing, for example an inner surface of said casing.

BACKGROUND

As illustrated in FIG. 1, a turbine engine, such as an aircraft turbofan or a c, conventionally comprises a fan casing 1, one substantially cylindrical wall 2 of which surrounds in particular the blades of the fan.

The casing 1 forms part of a nacelle that surrounds the motor of the turbine engine and inside of which rotates a fan that generates a secondary air flow that flows between the nacelle and the motor and forms a portion of the thrust produced by the turbine engine.

The casing 1 includes a substantially cylindrical wall 2 that comprises at the longitudinal ends thereof annular attachment flanges 3, 4. The downstream flange 4 is attached by means of the screw and nut type to a flange (not shown) of an intermediate casing and the upstream flange 3 is attached by means of the screw and nut type to a flange (not shown) of an air intake machine in the nacelle. The terms upstream and downstream are defined relative to the gas flow through the turbine engine.

The inner surface of a fan casing 2 conventionally comprises annular acoustic insulation panels that cover the inner cylindrical surface of the wall 2 and that are attached to said wall by any appropriate means. Said panels generally have a honeycomb annular structure, formed of adjacent cells, the inner and/or outer faces of which are each covered with a cladding, also known as skin. Said panels are particularly intended to absorb the sound waves generated by the fan of the turbine engine. More specifically, the casing 1 comprises an upstream panel, located upstream of the blades of the fan, a medial panel 5, located opposite the blades of the fan, and a downstream panel, located downstream of the blades of the fan. The medial panel 5 bears a layer 6 of abradable material against which the radially outer ends of the blades are intended to rub during operation.

In order to create the layer 6 of abradable material, portions 7 of abradable material paste in the form of balls or portions are arranged manually on the inner skin of the medial panel 5, as illustrated in FIG. 3 and the radially inner surface of the layer of abradable material 6 is created manually by scraping using a shape knife. More specifically, different knives are used successively, so as to perform one or more roughing passes and at least one finishing pass.

In the case of the embodiment illustrated in FIG. 2, an abradable layer 6 is obtained, the inner surface of which has a cylindrical upstream part 8, a cylindrical downstream part 9 of a thickness greater than that of the upstream part and a frustoconical part 10 connecting the upstream and downstream parts.

The abradable layer 6 is subsequently allowed to air dry so that it hardens and acquires the necessary mechanical characteristics.

A manufacturing process of this kind is long, laborious and expensive. Furthermore, the knives used for scraping tend to tear away material and form surface defects that subsequently require filling. During such filling, abradable material is added again and this addition may be of a different colour to that of the original material. The inner surface of the abradable layer obtained after such filling displays aesthetic defects in this case.

SUMMARY

The invention more particularly aims at providing a simple, efficient and cost-effective solution to this problem.

For this purpose, it provides for a device for applying abradable material, designed to apply abradable material to a surface of an annular casing of a turbine engine, wherein the casing extends along a longitudinal axis and the device comprises a support equipped with first guiding means capable of guiding the support in relation to a casing in a radial direction in relation to the axis of the casing, the support being equipped with second guiding means capable of guiding the support in relation to the casing in an axial direction, an application roller being pivotally mounted in relation to the support in the axial direction and adjustment means allowing adjustment of the position of the roller in relation to the first guiding means, in the radial direction.

Such a device can be used to distribute quickly and easily abradable material on the inner skin of a medial panel of a fan casing for example. For this purpose, a device of the aforementioned type can be mounted on the casing in such a manner that the first guiding means bear radially for example on the radially inner surface of the casing and in such a manner that the second guiding means bear axially for example on an end flange of the casing. All that is needed in this case is to move the device relative to the casing so that the roller pivots and rests on the abradable material in paste form, the roller thus distributing the malleable abradable material on the corresponding surface, in order to obtain the desired profile.

It may be necessary to pass the roller over the paste several times to obtain uniform distribution of the abradable material.

The adjustment means may allow performance of several rough passes, followed by one or more finishing passes. In this case, the position of the roller in relation to the cylindrical surface to which the abradable material is applied can be adjusted between passes using said adjustment means.

The first, guiding means may comprise rolling means capable of bearing on the casing in the radial direction and capable of moving on said casing.

Furthermore, the second guiding means may comprise rolling means capable of bearing on the casing in the axial direction and capable of moving on said casing.

This reduces friction when the device moves in relation to the casing, preventing any damage to the casing and making the device easy to operate.

The support may comprise a first part and second part movable in the radial direction in relation to the first part, with the roller being pivotally mounted on the second part of the support and the first guiding means and the second guiding means being mounted on the first part of the support.

In this case, the adjustment means can be mounted between the first part and the second part of the support and are designed to adjust the position of the second part in relation to the first part, in the radial direction.

The adjustment means may in this case comprise at least one screw interacting with at least one nut, with pivoting of the screw in relation to the nut causing translational movement of the second part in relation to the first part.

Provision may be made for translational guiding means for guiding the second part in relation to the first part, in the radial direction. Such guiding means may for example include at least one guiding rod or at least one guiding stud integral with one of the parts of the support, with the rod or the stud being mounted to move in translation in a guiding hole or ring of the other part of the support, for example.

The support may comprise gripping means, for example at least one handle.

In particular, at least one handle can be oriented so as to facilitate application of the first guiding means bearing on the casing, in the radial direction and at least a second handle can be oriented so as to facilitate application of the second guiding means bearing on the casing, in the axis direction.

The roller may comprise at least two parts capable of pivoting independently of each other; for example, at least one cylindrical part and at least one frustoconical part.

For example, the roller may comprise two cylindrical end parts of different diameters and a frustoconical medial part, the surface of the roller being preferably continuous from one part to the other.

The roller can also consist of at least two parts with different profiles and/or furthermore different surface finishes.

Constructing the roller in several parts limits sliding phenomena at the interface between the roller and the abradable material, in order to avoid detachment or tearing off of abradable material during its application. This obviates having to fill in such detached or torn areas.

The invention also relates to a method for applying abradable material to a turbine engine casing, comprising the stages involving:

- applying abradable material paste to an annular surface of the casing,
- mounting a device of the aforementioned type on the casing in such a manner that the first guiding means bear radially on an annular surface of the casing, for example a radially inner surface and in such a manner that the second guiding means bear axially on a bearing surface of the casing, for example on an end flange of the casing,
- moving the device relatively in relation to the casing so that the roller pivots and rests on the abradable material in paste form, the roller thus distributing the malleable abradable material in paste form on the corresponding surface, As previously indicated, such a method may comprise one or more rough passes, followed by one or more finishing passes. For this purpose, the radial position of the roller in relation to the cylindrical surface to which the abradable material is applied can be adjusted between passes using the adjustment means.

According to one alternative embodiment, it is possible to proceed by angular sections of the inner surface of the housing. Thus, the paste can be applied and the aforementioned device can be moved over an angular section of the inner surface of the casing and the casing can subsequently be pivoted around its axis by a predetermined angle, before the paste is applied and the aforementioned device is moved over a new angular section of the inner surface of the casing.

The method may also comprise a stage of drying the material, for example in the open air.

The abradable material used is for example an epoxy resin-based polymer material comprising hollow beads, for example hollow glass beads.

BRIEF DESCRIPTION OF THE DRAWINGS

The invention will be better understood and other details, characteristics, and advantages of the invention will appear on reading the following description given by way of non-limiting example and with reference to the accompanying drawings, in which.

DETAILED DESCRIPTION

Figure 4:
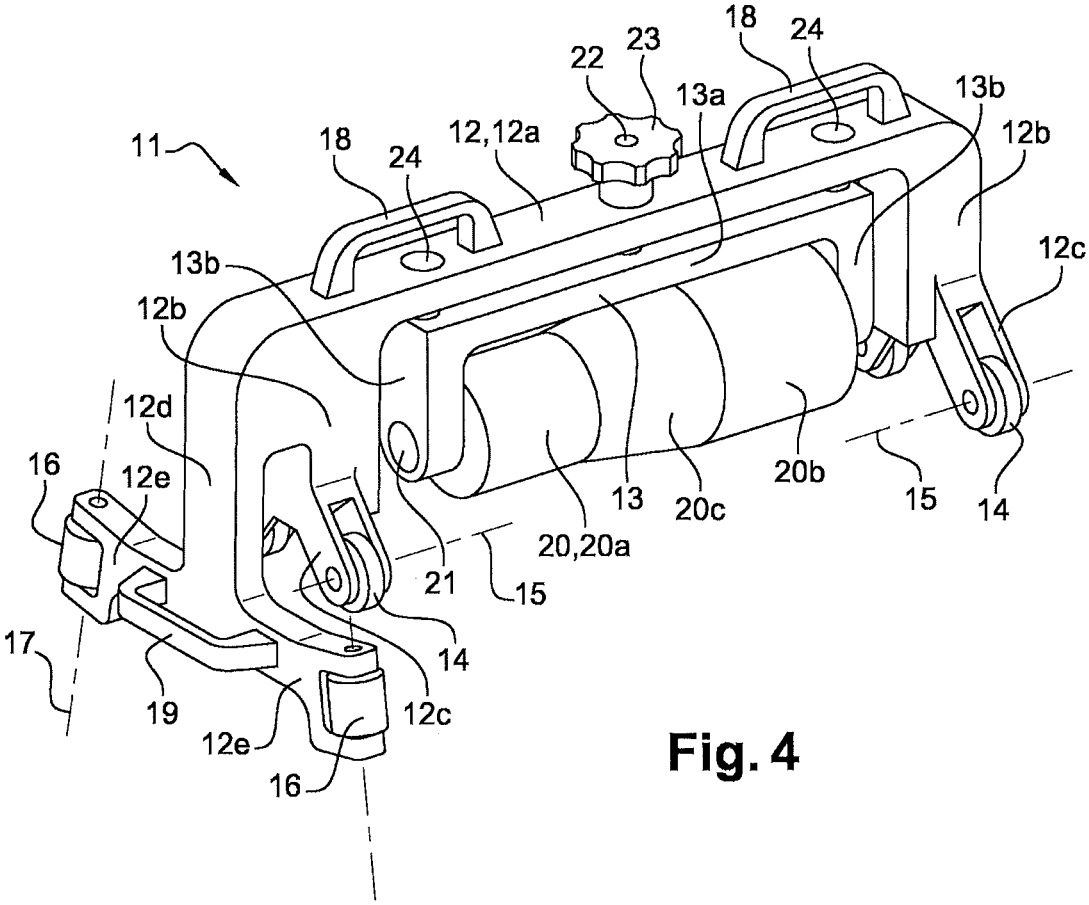
FIG. 4 is a perspective view of the device according to the invention.
Figure 5:
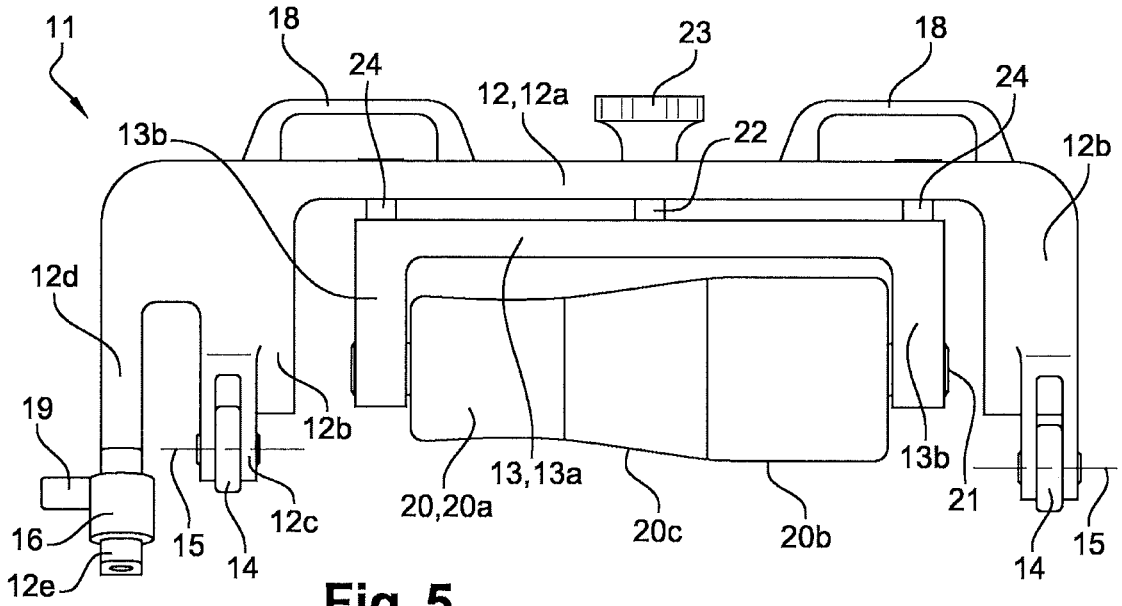
FIG. 5 is a front view of the device in FIG. 4.

FIGS. 4 and 5 illustrate a device 11 for applying abradable material, designed to apply abradable material to a surface of a turbine engine casing 1.

The device 11 features a support comprising a first part 12 and a second part 13. The first part 12 has, when viewed from the front, an overall U shape comprising a base 12*a* from which two branches 12*b* extend. The free end of each branch 12*b* has two opposite legs 12*c*, each leg 12*c* carrying a running roller 14, the axes of rotation 15 of which are parallel to the base 12*a*. The first part 12 of the support furthermore comprises an additional branch 12*d*, extending from a lateral end of the base 12*a* and extending parallel to the branches 12*b*. The free end of the additional branch 12*d* has two opposite legs 12*e* each carrying a running roller 16, the axis of rotation 17 of which is parallel to the branches 12*b*, 12*d* i.e. perpendicular to the axes of rotation 15 of the running rollers 14.

Two gripping handles 18 are fixed to the base 12*a* and a handle 19 is fixed to the legs 12*e* of the additional branch 12*d*.

The second part 13 of the support is mounted between the branches 12*b* of the first part 12, with the second part 13 having an overall U shape and comprising a base 13*a* with two branches 13*b* extending on either side thereof. A roller 20 is pivotally mounted around a shaft 21 extending parallel to the pivot axes 15 of the running rollers 14. The ends of the shaft 21 are engaged in the branches 13*b* of the second part 13, the latter thereby forming a yoke. The roller 20 has three constituent parts 20*a*, 20*b* and 20*c* capable of pivoting independently of each other around the shaft 21. In particular, the roller 21 comprises two cylindrical parts 20*a*, 20*b* of different diameters, connected by a frustoconical medial part 20*c*. The part 20*a* located near the additional branch 12*d* is for example smaller in diameter than the part 20*b*. The different parts 20*a*, 20*b*, 20*c* are dimensioned so as to ensure surface continuity of the roller 20.

The support 12, 13 is equipped with adjustment means for adjusting the position of the roller 20. Said adjustment means comprise a bolt formed or mounted in the base 13*a* of the second part 13 for example, and a screw 22 engaged in a pivot in the base 12*a* of the first part 12. The screw 22 is equipped with a gripping head 23. The screw 22 and the corresponding nut are arranged in such a way that rotation of the screw 22 makes it possible to change the position of the second part 13 relative to the first part 12, along the axis of the screw 22, i.e. along an axis perpendicular to the axis of the roller 20.

In order to guide such translational movement, the support 12, 13 can be equipped with guiding rods 24 arranged laterally for example on either side of the screw 22 and the nut. In particular, the rods 24 can be fixed to the base 12*a* of the first part 12 and be engaged in holes with a matching section or in guiding rings of the second part 13.

Likewise, the tool can allow adjustment in the axial direction, for example, between parts 12*d* and 12*b*, it would also be possible to have an adjustment means that would make it possible to adapt the invention to different casing sizes.

Figure 6:
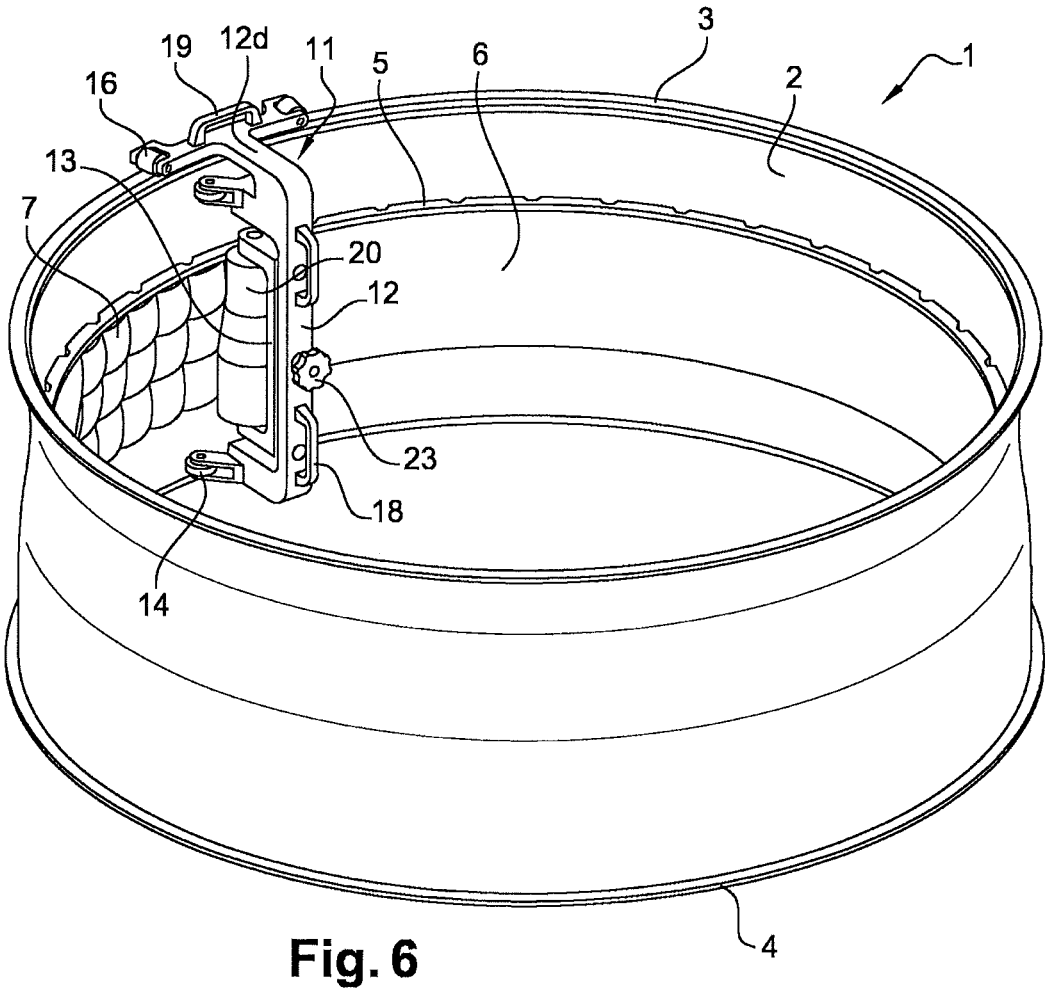
FIG. 6 represents the method of applying the abradable material according to an embodiment of the invention in which the axis of the casing is oriented vertically.

As shown in FIG. 6, such a device 11 can be used to form the layer 6 of abradable material of a fan casing 1 of a turbine engine, such as an aircraft turboprop engine.

In the case illustrated in FIG. 6, the fan 1 is arranged such that its axis extends vertically, abradable material in paste form being applied, for example in portions 7, to an area to be covered, for example to the radially inner skin of a panel 5 of the fan casing 1. The abradable material used is for example an epoxy resin-based polymer material comprising hollow beads, for example hollow glass beads.

The aforementioned device 11 is subsequently arranged on the casing 1 such that the roller 20 extends along the axis of the casing 1, the running rollers 16 rest on one of the end flanges 3, 4 of the casing 1 and the running rollers 14 rest on the radially inner surface 2 of the casing 1, axially on either side of the panel 5 bearing the abradable material.

The running rollers 14, 16 are kept in contact with the areas involved of the casing 1 by the operator's pressing on the handles 18, 19. The handles 18 are thus used to hold the device 11 radially on the inner surface 2 of the casing 1 and the handle 19 is used to hold the device 11 axially on the corresponding end flange 3, 4.

The device 11 is subsequently moved in relation to the casing 2 over the entire periphery of the casing 1 so as to smooth the abradable material in paste form and define the layer of abradable material 6. During this stage, the different parts 20*a*, 20*b*, 20*c* of the roller 20 pivot around their axis 21 and press or repel the malleable paste. It should be noted that constructing the roller 20 in several parts 20*a*, 20*b*, 20*c* limits sliding phenomena at the interface between the roller 20 and the abradable material, in order to avoid detachment or tearing off of abradable material during its application.

One or more rough passes followed by one or more finishing passes can be performed successively. For this purpose, the radial position of the roller 20 in relation to the cylindrical surface to which the abradable material is applied can be adjusted between passes using the adjusting screw 23.

Figure 1:
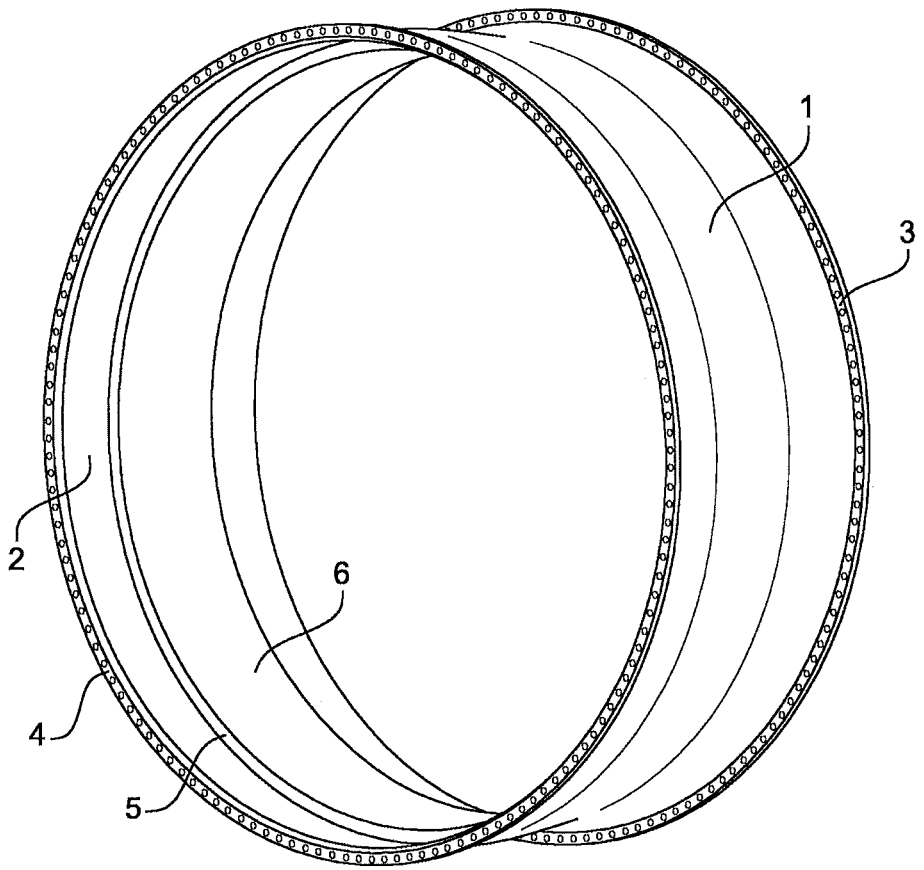
FIG. 1 is a perspective view of a turbine engine fan casing comprising a layer of abradable material.
Figure 2:
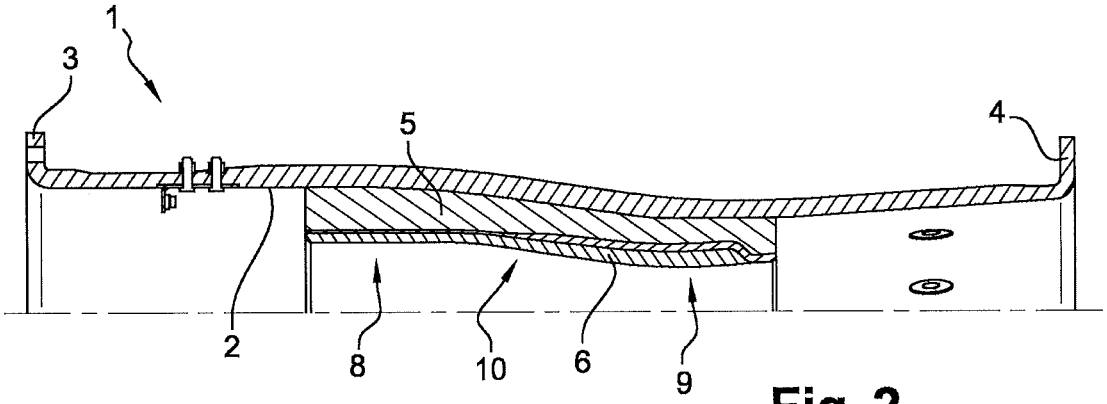
FIG. 2 is a cross-sectional half-view illustrating a section of the fan casing in FIG. 1.
Figure 3:
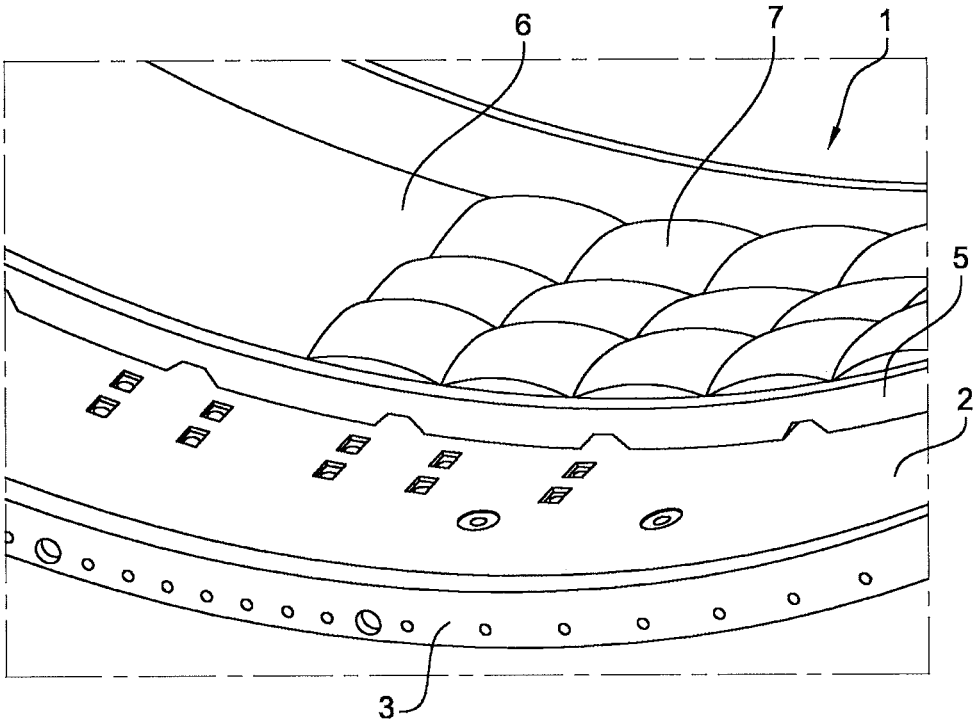
FIG. 3 is a detailed diagrammatic view illustrating in particular the application of portions of abradable material paste on the corresponding cylindrical surface of the fan casing.

Following the different passes, the radially inner surface of the layer of abradable material 6 has two cylindrical sections 8, 9 of different diameters and a frustoconical section 10 connecting the two cylindrical sections (FIG. 2).

The abradable layer 6 is subsequently allowed to air dry so that it hardens and acquires the necessary mechanical characteristics.

Figure 7:
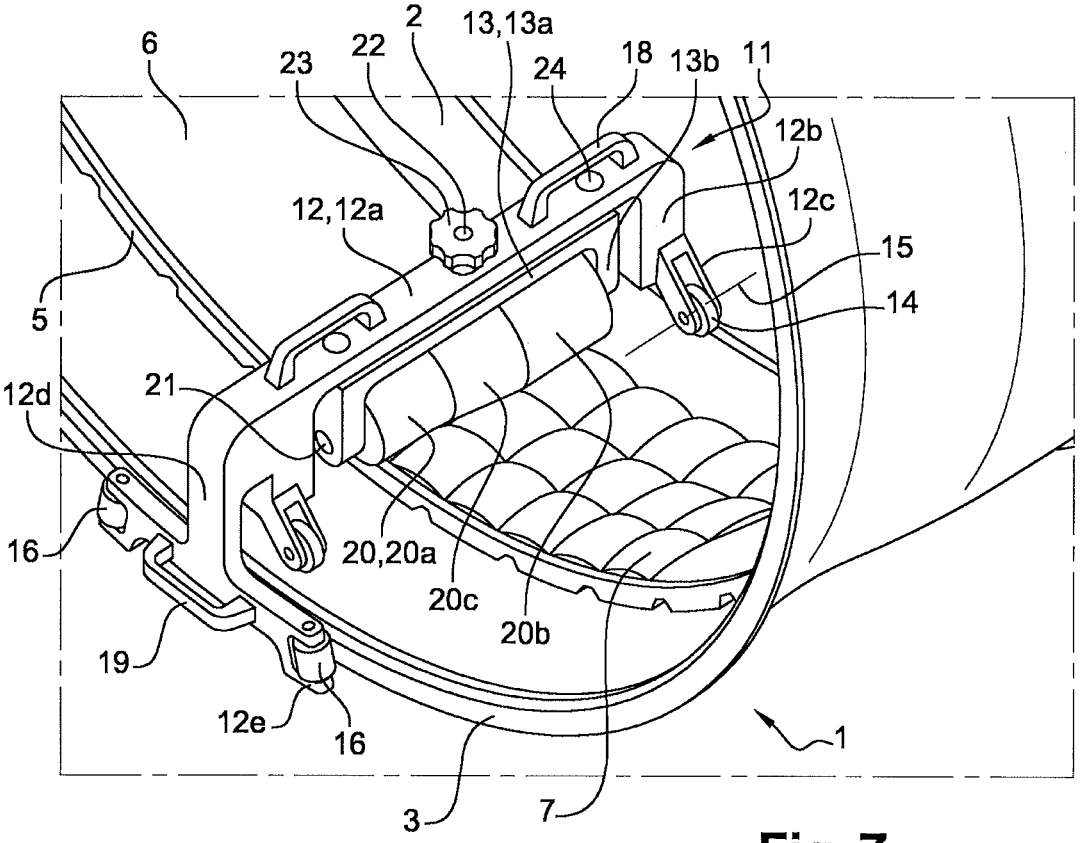
FIG. 7 represents the method of applying the abradable material according to an embodiment of the invention in which the axis of the casing is oriented horizontally.

FIG. 7 illustrates an alternative embodiment wherein the casing 1 is positioned so that its axis extends horizontally.

The invention thus provides for a device and a method allowing quick and easy forming of the layer of abradable material 6 of a fan casing 1 of a turbine engine for example.

The invention claimed is:

1. A device for applying abradable material, designed to apply abradable material to a surface of an annular casing of a turbine engine, wherein the casing extends along a longitudinal axis and the device comprises a support equipped with first guiding means capable of guiding the support in relation to the casing in a radial direction in relation to the axis of the casing, the support being equipped with second guiding means capable of guiding the support in relation to the casing in an axial direction of the casing, an application roller being pivotally mounted in relation to the support in the axial direction and adjustment means allowing adjustment of the position of the roller in relation to the first guiding means, in the radial direction, wherein the device is configured to be mounted on the casing and move relative to a fixed location of the casing during application of the abradable material.

2. The device according to claim 1, wherein the first guiding means comprises rolling means capable of bearing on the casing in the radial direction and capable of moving on said casing.

3. The device according to claim 1, wherein the second guiding means comprises rolling means capable of bearing on the casing in the axial direction and capable of moving on said casing.

4. The device according to claim 1, wherein the support comprises a first part and a second part movable in the radial direction in relation to the first part, with the roller being pivotally mounted on the second part of the support and the first guiding means and the second guiding means being mounted on the first part of the support.

5. The device according to claim 4, wherein the adjustment means can be mounted between the first part and the second part of the support and are designed to adjust the position of the second part in relation to the first part, in the radial direction.

6. The device according to claim 5, wherein the adjustment means comprise at least one screw interacting with at least one nut, with pivoting of the screw in relation to the nut causing translational movement of the second part in relation to the first part.

7. The device according to claim 5, further comprising translational guiding means for guiding the second part in relation to the first part, in the radial direction.

8. The device according to claim 1, wherein the support comprises gripping means.

9. The device according to claim 1, wherein the roller comprises at least two parts capable of pivoting independently of each other.

10. The device of claim 8, wherein the gripping means comprises a handle.

11. The device according to claim 9, wherein the at least two parts capable of pivoting independently of each other comprise at least one cylindrical part and at least one frustoconical part.

* * * * *